US005623917A

United States Patent [19]

Dinaso et al.

[11] Patent Number: 5,623,917

[45] Date of Patent: Apr. 29, 1997

[54] SEALED BURNER ASSEMBLY

[75] Inventors: Joseph Dinaso, Lady Lake, Fla.; Julia L. Wright, Clarksville, Tenn.

[73] Assignee: White Consolidated Industries, Inc., Cleveland, Ohio

[21] Appl. No.: 576,494

[22] Filed: Dec. 21, 1995

[51] Int. Cl.[6] ..... F24C 3/00

[52] U.S. Cl. ..... 126/39 H; 126/39 R

[58] Field of Search ..... 126/39 R, 39 H, 126/39 N

[56] References Cited

U.S. PATENT DOCUMENTS 4,572,154 2/1986 Schweitzer .
4,705,019 11/1987 Beach et al. .
5,152,276 10/1992 Brock et al. .
5,323,759 6/1994 Hammel et al. .
5,468,145 11/1995 Ferlin ..... 126/39 R

*Primary Examiner*—Carroll B. Dority
*Attorney, Agent, or Firm*—Pearne, Gordon, McCoy & Granger

[57] ABSTRACT

A gas burner assembly for a domestic appliance including a mounting bracket secured to a gas burner and cooperating with an appliance top panel to removably secure the burner to the top panel. The mounting bracket engages one surface of the top panel while the burner engages another surface of the panel to retain the burner relative to the top panel.

13 Claims, 9 Drawing Sheets

22
52
50
48
44
30
54
58
54
46
56
38
34
24
42
38
40
40
32
36
53
28
26

Fig.3
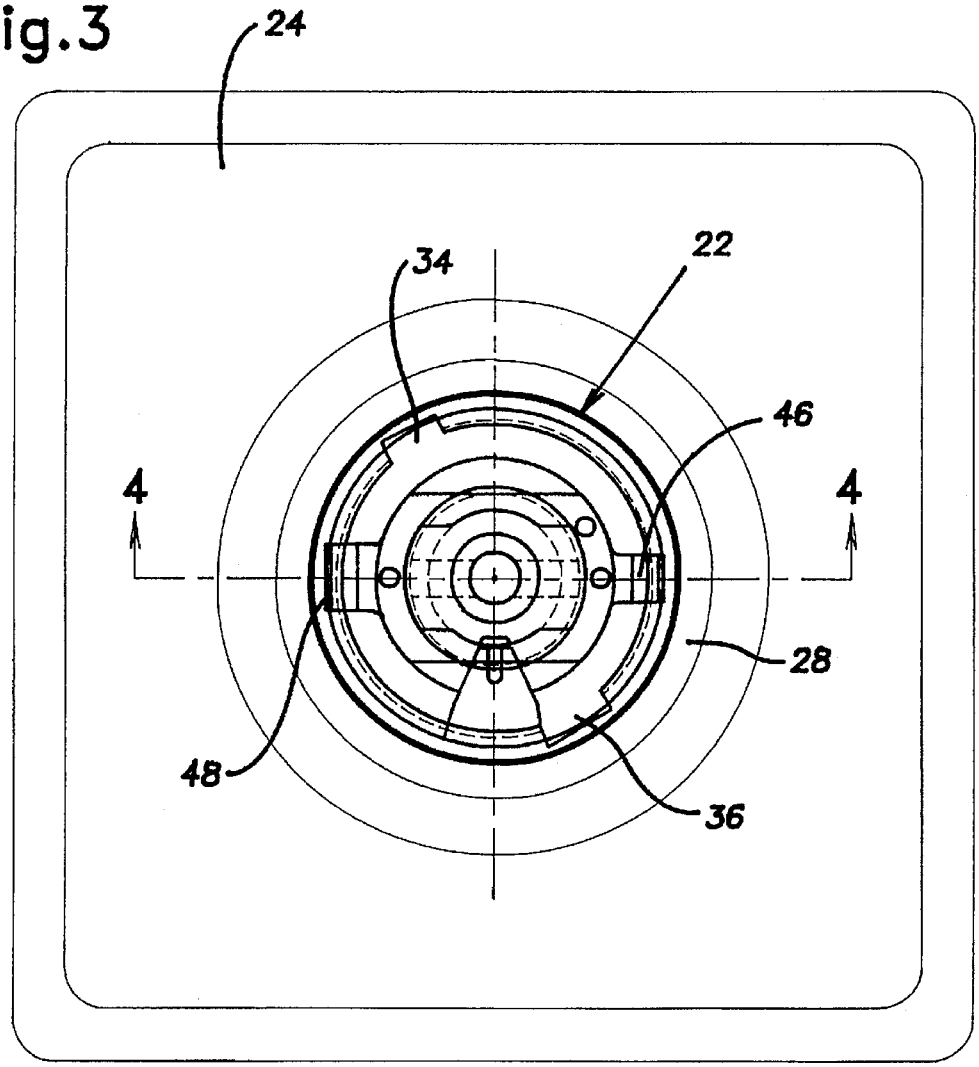
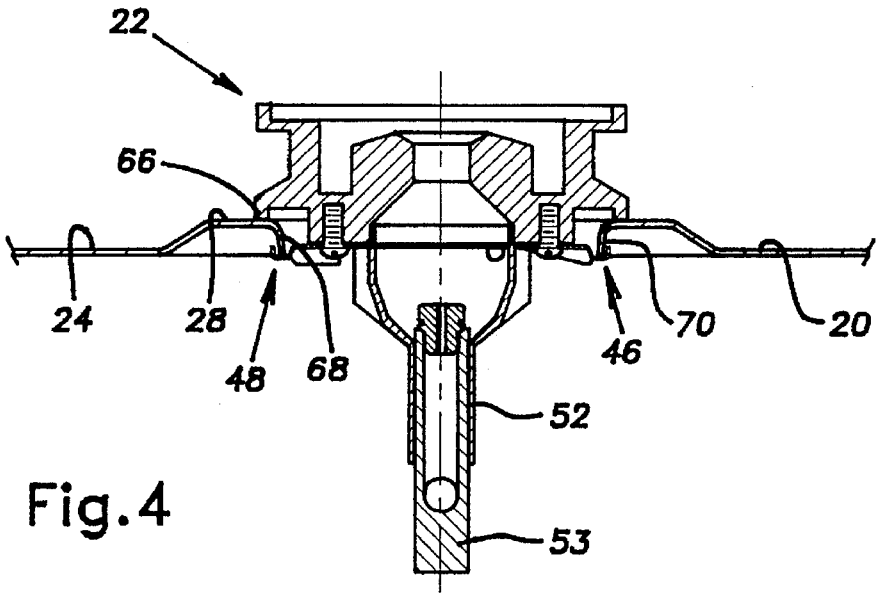
Fig.4

22
52
92
88
80
90
98
84
24
20
86
86
82
53

Fig.7
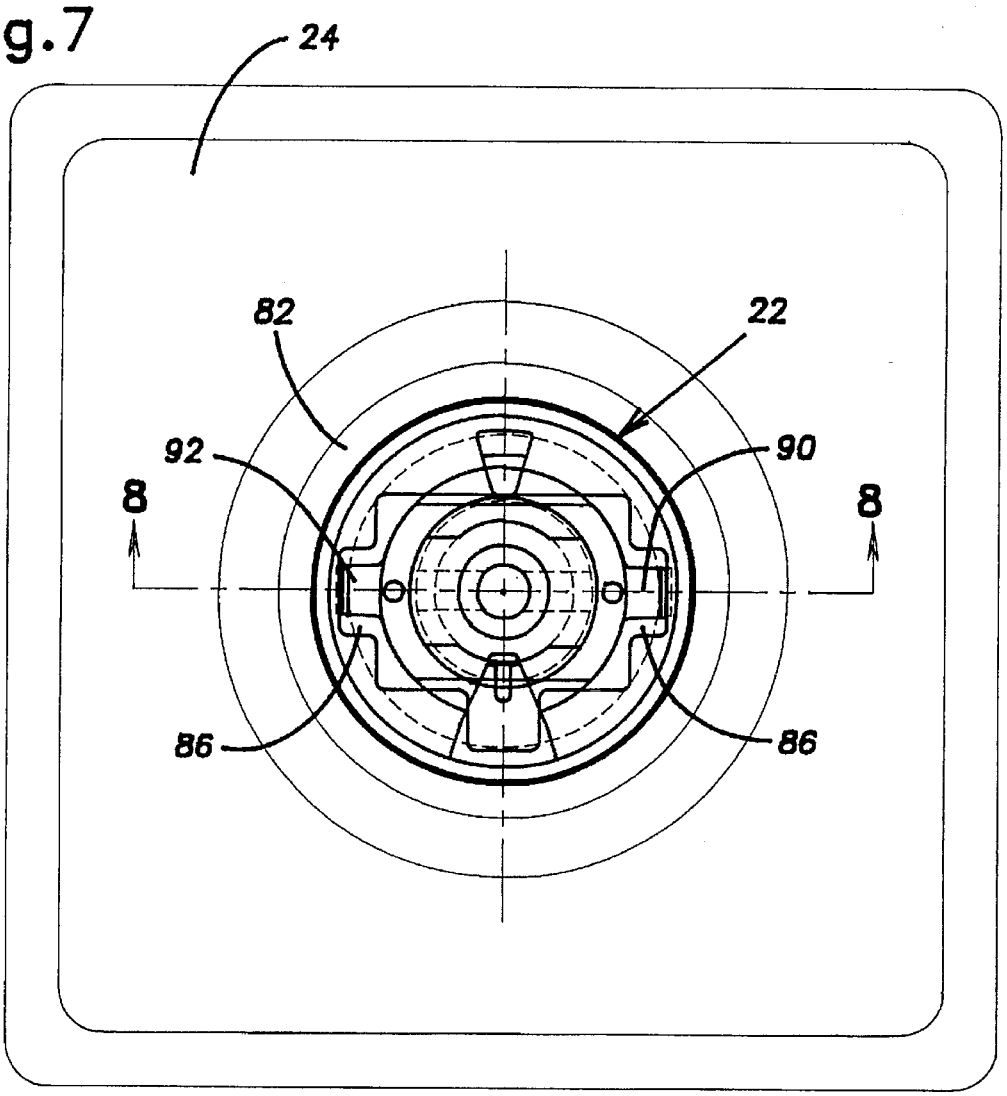
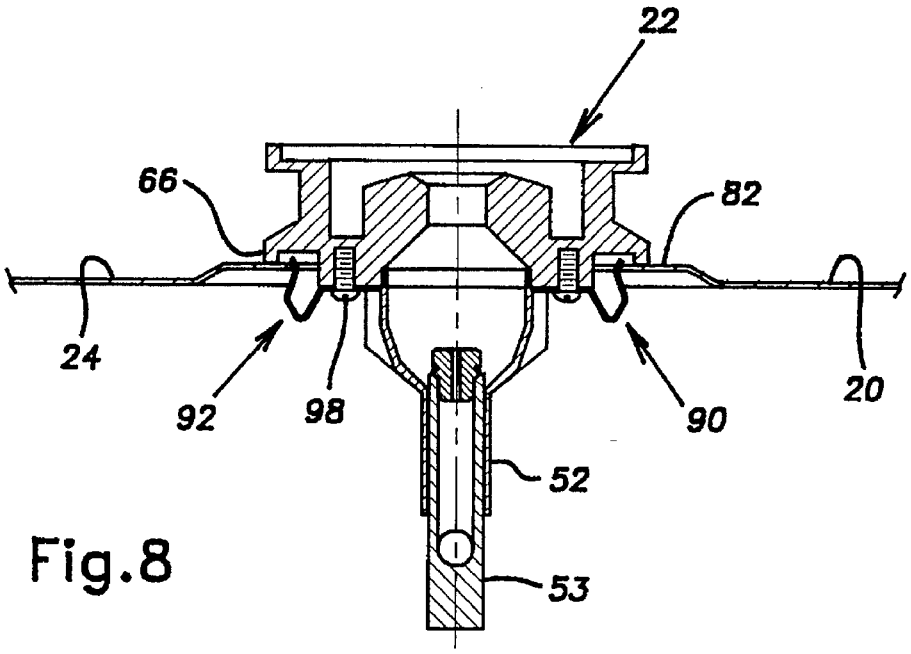
Fig.8

22
52
122
120
110
122
128
114
20
118
112
116
116
118
53
24

Fig.11
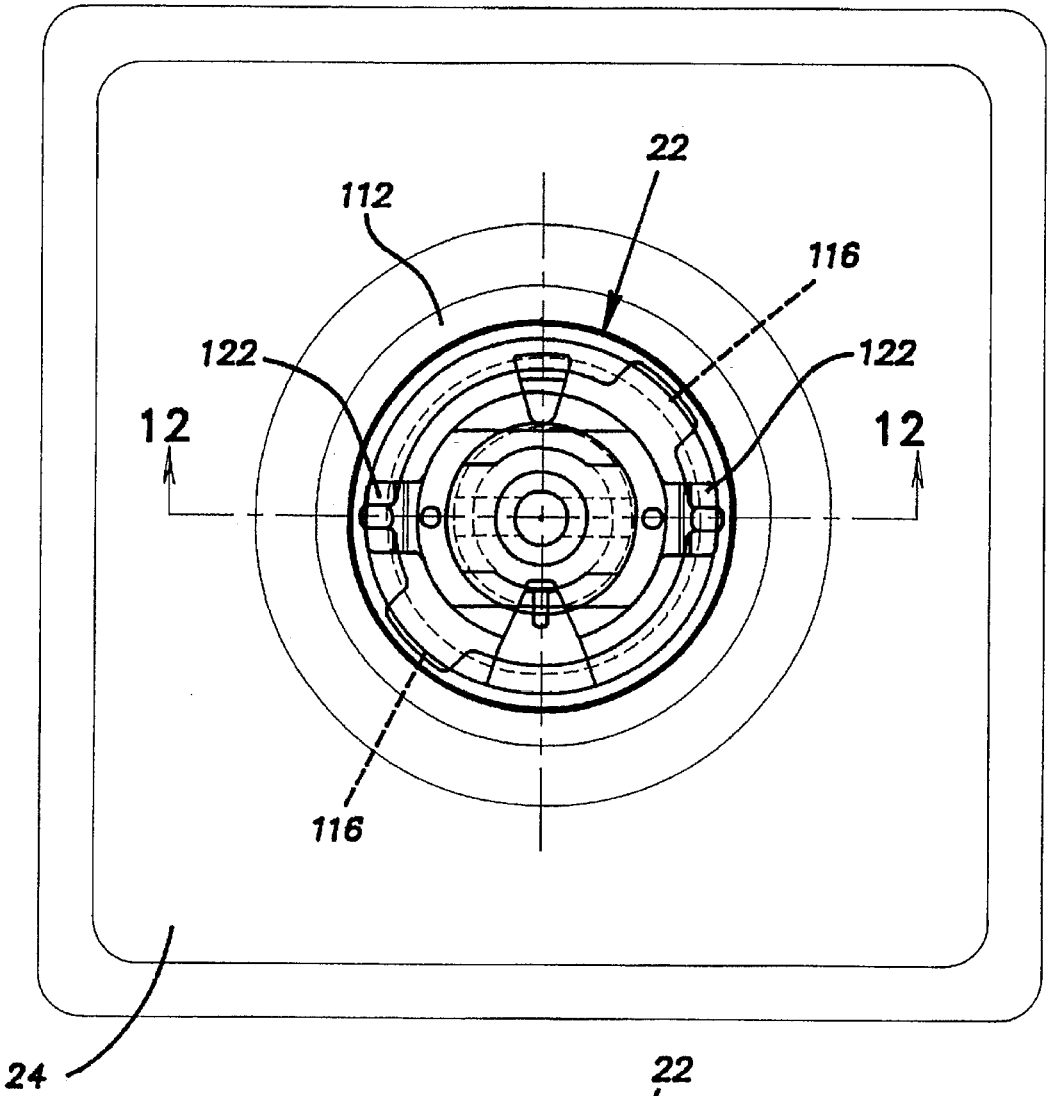
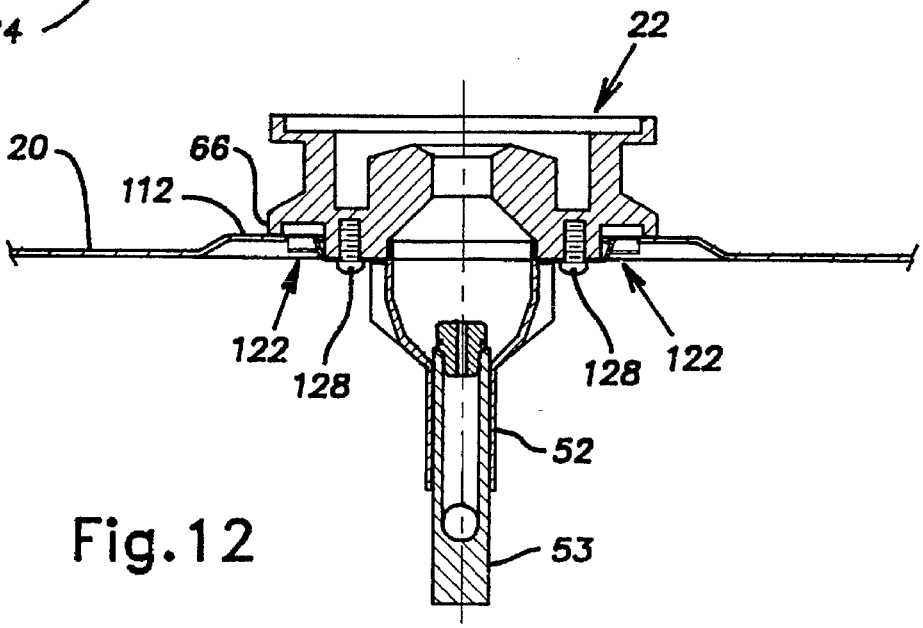
Fig.12

SEALED BURNER ASSEMBLY

BACKGROUND OF THE INVENTION

1. Field of the Invention

The present invention generally relates to gas burner assemblies and, more particularly, to sealed gas burner assemblies for domestic ranges or cook tops.

2. Description of Related Art

Several different types of removable sealed gas burners are known in the appliance art. These burners typically include bosses that cooperate with recesses on the top panel to provide a twist-and-lock feature.

For example, U.S. Pat. No. 5,152,276, the entire disclosure of which is incorporated herein by reference, provide a burner having a cylindrical base from which extend a pair of proturbances. The range top has a cylindrical flange with dog-leg shaped recesses that receive the proturbances in a twist-and-lock manner. Unfortunately, the mounting system of the '276 patent is highly expensive to manufacturing, requires tight manufacturing tolerances, and therefore, is not commercially feasible on most models of household ranges or cook tops.

U.S. Pat. No. 4,572,154 shows a burner mounted with spring clips to a range top. A burner opening in the range top is circular and does not orient the burner relative to the range top. The mounting arrangement of the '154 patent does not positively position the burner and does not prevent rotation of the burner.

Therefore, there exists a need in the art for a simple and inexpensive device for releasably attaching a gas burner to a top panel of a range. There also exists a need in the art for such a device which positively locates the burner relative to the range top and which prevents rotation of the burner.

SUMMARY OF THE INVENTION

The present invention is directed toward a simple and inexpensive device for removably securing a burner to a range top panel.

In accordance with the present invention, a burner assembly includes a range top including a recessed well and defining a burner opening in the well. The range top has first and second surfaces.

In further accordance with the present invention, a burner includes a body member having a burner tube extending downwardly therefrom. A burner mounting bracket is secured to the lower surface of the burner. The mounting bracket has first and second mounting wings extending therefrom. The lower burner surface engages the range top first surface, and the mounting wings engage the range top second surface.

BRIEF DESCRIPTION OF THE DRAWINGS

These and further features of the present invention will be described hereafter with reference to the drawings, wherein:

FIG. 3 is a top plan view of the first embodiment depicted in FIG. 2;

FIG. 4 is a cross-sectional view as seen by line 4—4 of FIG. 3;

FIG. 7 is a top plan view of the second embodiment depicted in FIG. 8;

FIG. 8 is a cross-sectional view as seen along line 8—8 of FIG. 7;

FIG. 11 is a top plan view of the third embodiment depicted in FIG. 10;

FIG. 12 is a cross-sectional view as seen along line 12—12 of FIG. 11;

DETAILED DESCRIPTION OF THE DRAWINGS

Figure 1:
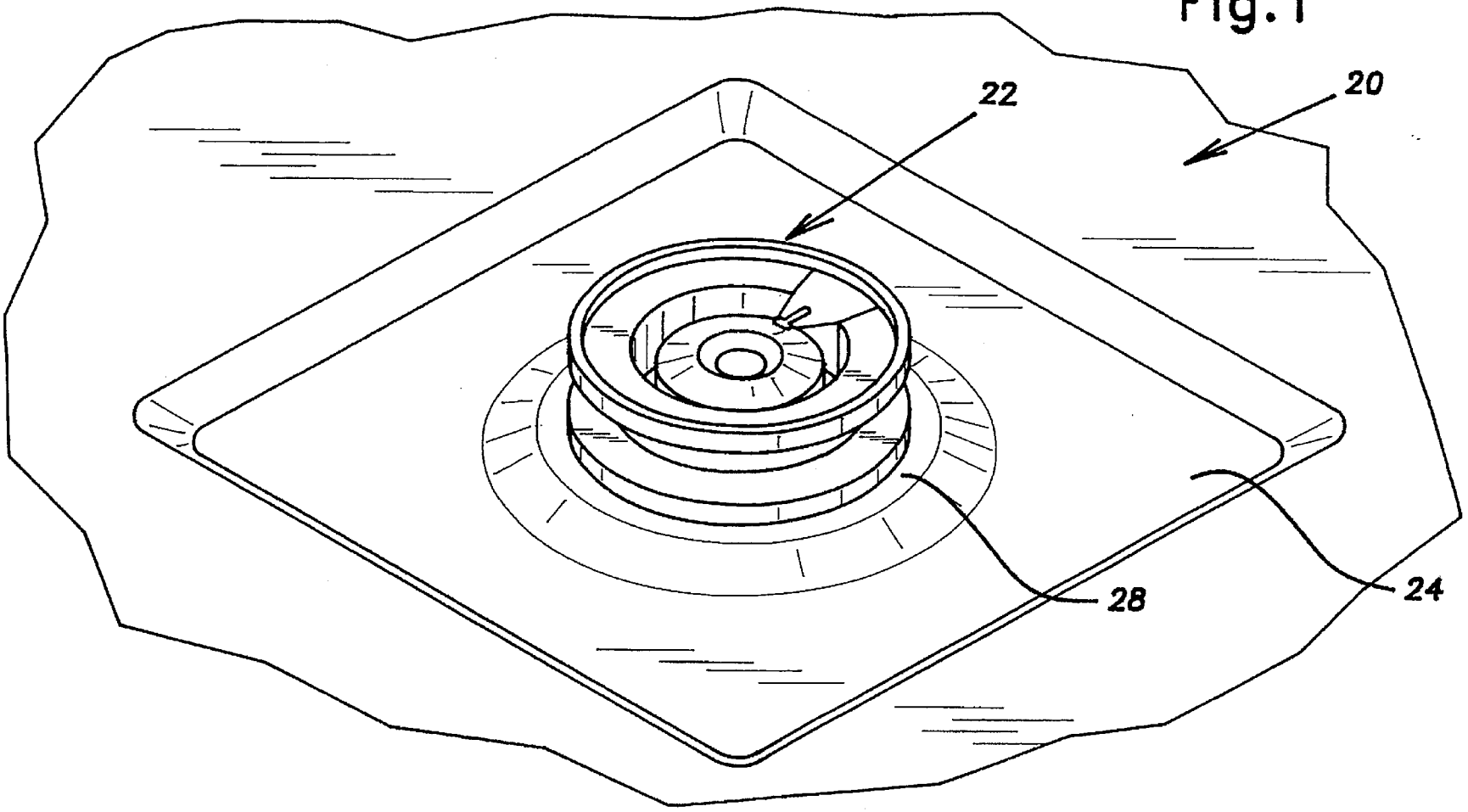
FIG. 1 is a perspective view of a gas burner mounted to a range top according to the present invention.
Figure 2:
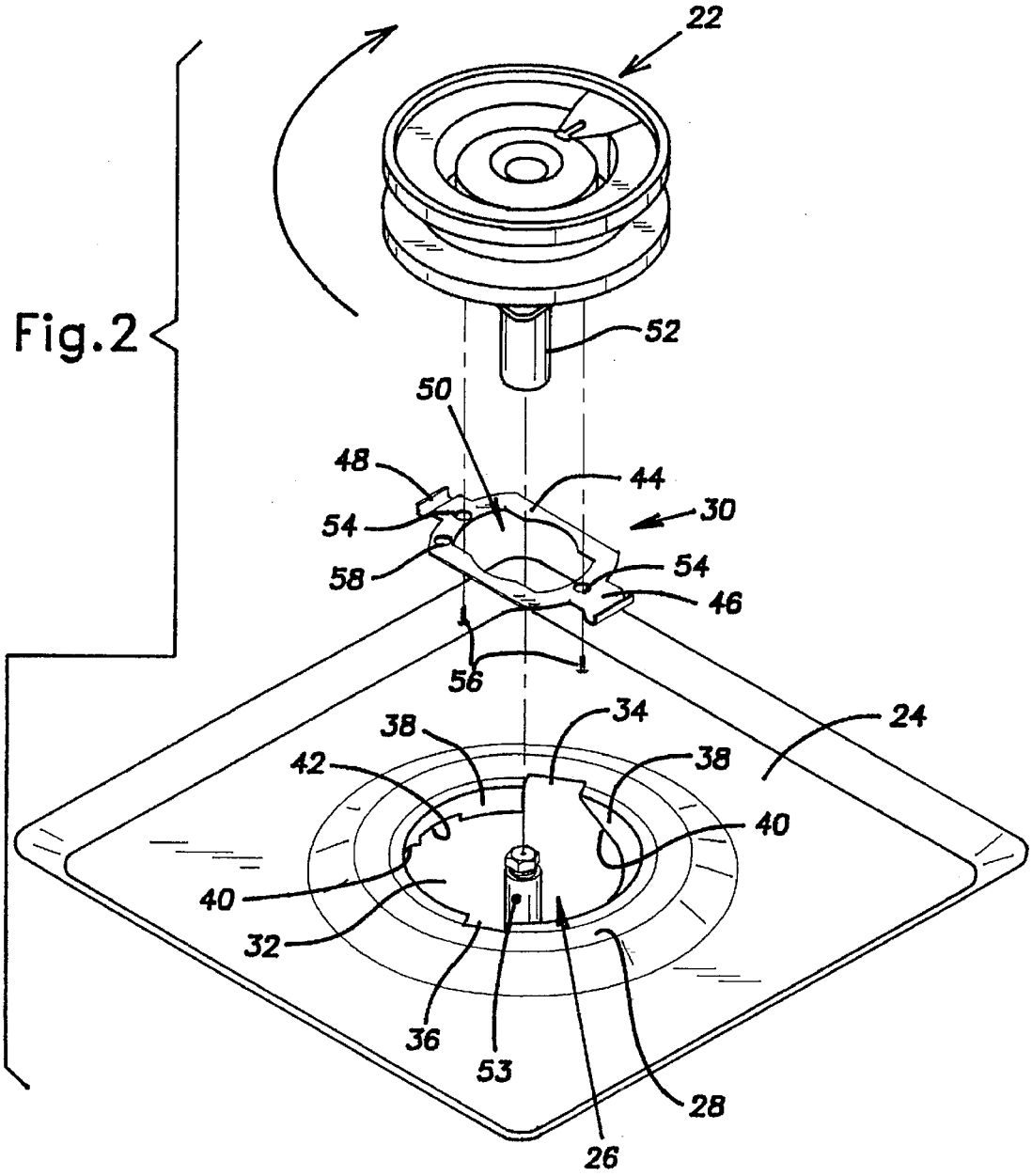
FIG. 2 is an exploded perspective view of a gas burner, mounting bracket, and range top according to a first embodiment of the present invention.

With reference to FIG. 1, a portion of a gas range or cook top is shown to include a main top panel 20 and a gas burner 22. The main top panel 20 defines a recessed well 24 in which the burner 22 is mounted. A burner opening 26 (FIG. 2) is formed in the well 24, and is surrounded by a raised annular portion 28. The raised annular portion 28 tends to prevent liquids received within the well 24 from leaking through the burner opening 26.

It is contemplated that more than one burner may be mounted within a single recessed well. It is further contemplated that the raised portion may be formed in a variety of shapes without changing its function or usefulness in conjunction with the present invention.

With reference to FIGS. 2–5C, a first embodiment of the present invention is shown to include the gas burner 22, a mounting bracket 30, and the main top well 24 having a burner opening 26 formed therein. The burner opening 26 has a circular main opening 32 from which radially extend first and second notched openings 34, 36. The first notched opening 34 is preferably larger than the second notched opening 36, as illustrated.

A pair of downwardly-directed walls 38, which define cam surfaces 40, extend downwardly from the annular surface 28 and radially surround the burner opening 26. The cam surfaces 40 slope from one of the notched openings 34, 36 toward the other notched opening 36, 34. A step 42 (one shown) is formed in the cam surface 40 of each wall 38, and serves as a stop to limit rotation of the mounting bracket 30 and burner 22, as will be described more fully hereafter.

The mounting bracket 30 has a generally planar body member 44 from which project first and second oppositely extending mounting wings 46, 48. The first mounting wing 46 is slightly larger in width than the second mounting wing 48. The body member 44 defines an enlarged central opening 50 through which a burner tube extends 52, a pair of apertures 54 through which mounting screws 56 extend to secure the mounting bracket 30 to the burner 22, and an alignment opening 58 adjacent the second wing 48. The alignment opening 58 receives a mounting spud (not shown) projecting downwardly from the burner 22 and serves to properly position the mounting bracket 30 on the burner 22.

Figure 5A:
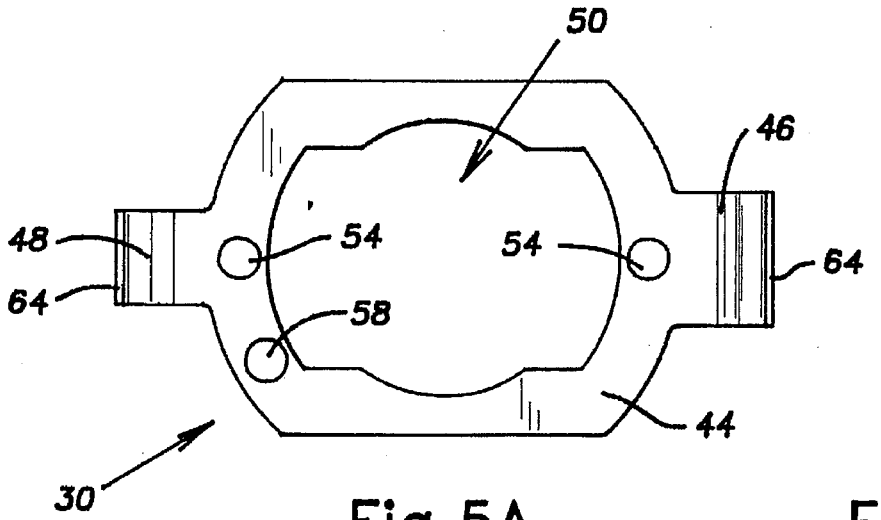
FIG. 5A is a top plan view of the mounting bracket according to the first embodiment of the present invention.
Figure 5B:
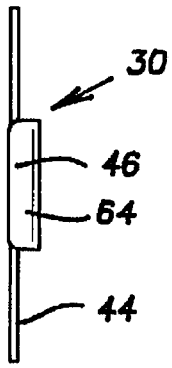
FIG. 5B is a side elevational view of the mounting bracket according to the first embodiment of the present invention.
Figure 5C:
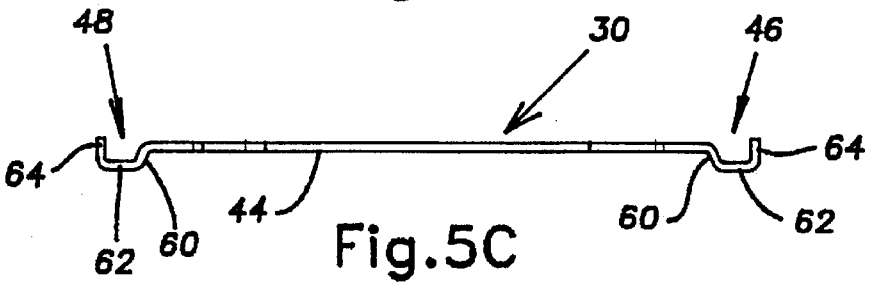
FIG. 5C is a front elevational view of the mounting bracket according to the first embodiment of the present invention.

The structure of the mounting bracket 30 is best seen in FIGS. 5A to 5C, wherein it is shown that the mounting wings 46, 48 are generally U-shaped. More specifically, each of the wings has a first segment 60 extending downwardly from the plane defined by the body member 44, a second segment 62 generally parallel to the body member 44, and a third segment 64 extending upwardly and terminating generally at an imaginary inter-section with an extension of the planar body 44. As will be described more fully hereafter, the second segment 62 is adapted to engage the cam surface 40 provided by the main top panel 20.

With reference to FIGS. 3 and 4, the mounting bracket 30 is shown mounted to the burner 22 and secured to the main top panel 20. The burner tube 52 is placed over a burner tube fitting 53. An annular wall 66 provided by the burner bottom is in direct engagement with the raised annular portion 28 or first surface of the top panel surrounding the burner opening 26. The mounting wings 46, 48 are received within the steps 42 provided by the walls 38 engage a second surface of the top panel, and prevent rotation of the burner 22.

With the mounting bracket 30 attached to the burner 22, the burner 22 is removably secured to the main top panel 20 by inserting the first and second mounting wings 46, 48 into the first and second notched openings 34, 36, respectively, and inserting the burner tube fitting 53 into the burner tube 52. The wings 46, 48 and openings 34, 36 are dimensioned to permit installation of the burner in only the proper orientation, as will be apparent to those skilled in the art. The burner 22 is rotated (clockwise in the illustrated embodiment) such that the first segment 60 is adjacent a radially inner side 68 of the downwardly extending wall 38, the second segment 62 slides along the camming surface 40, and the third segment 64 is adjacent a radially outermost side 70 of the wall 38.

Rotation of the burner 22 moves the wings 46, 48 along the camming surfaces 40 and draws the burner downwardly toward the main top panel 20. Further rotation of the burner causes the mounting wings 46, 48 to snap into the steps 42 formed in the downwardly extending wall 38. As such, the raised annular portion 28 is trapped between the annular wall 66 of the burner and the second segment 62 of the mounting wings 46, 48. The burner can be removed for cleaning or maintenance by simply rotating the burner (counterclockwise in the illustrated embodiment). Once the steps 42 are overcome, the mounting wings 46, 48 will easily pass over the camming surface 40 toward the notched openings 34, 36.

Figure 6:
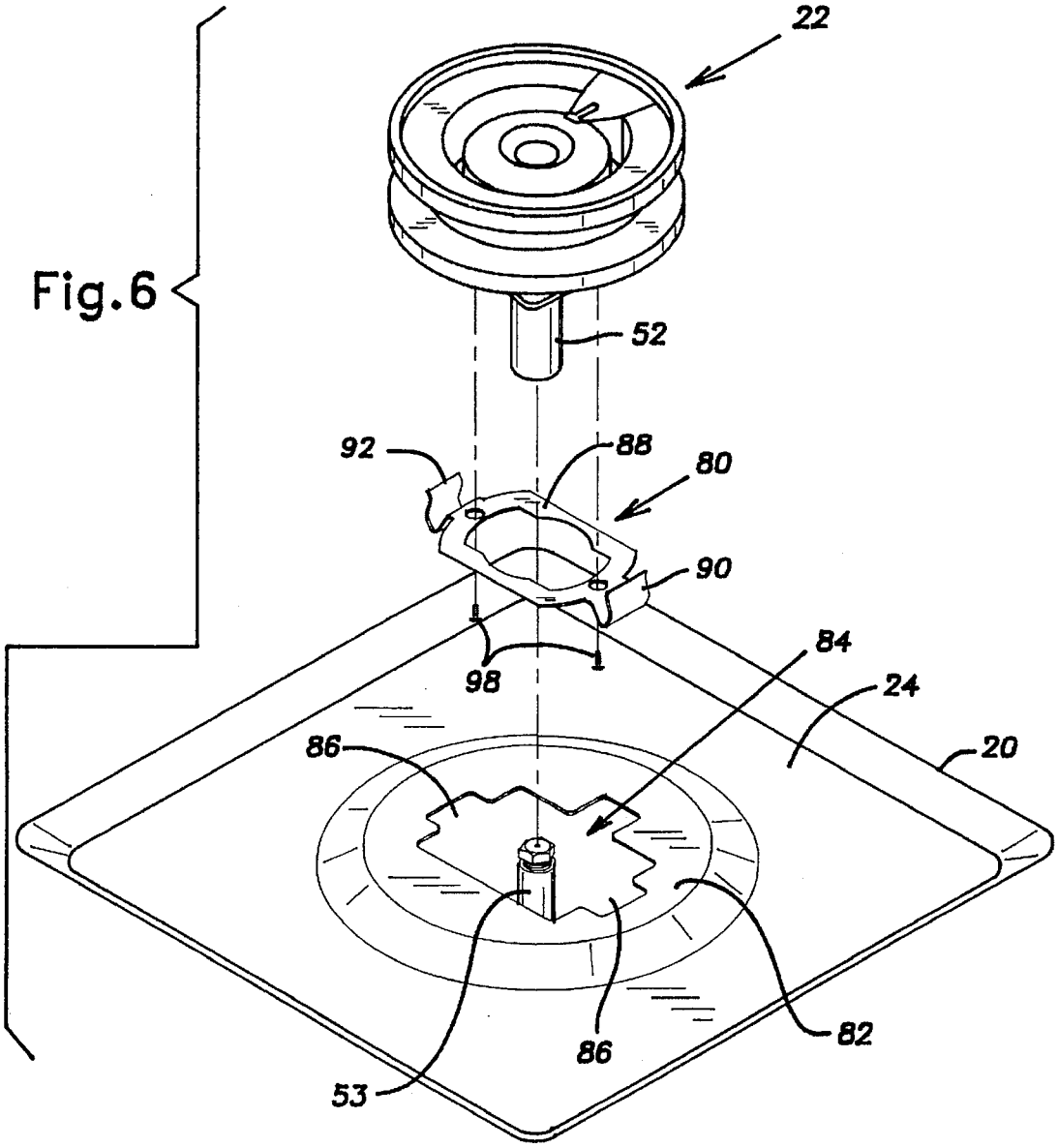
FIG. 6 is an exploded perspective view of a gas burner, mounting bracket, and range top according to a second embodiment of the present invention.

With reference to FIGS. 6–9C, a second embodiment of the present invention is illustrated. FIG. 6 shows a mounting bracket 80 and its corresponding main top panel 20. The main top panel 20 provides a well 24 which includes a raised, generally planar surface 82. A burner opening 84 is formed in the surface 82. The burner opening 84 is generally rectangular, and has a pair of opposed mounting openings 86 to receive the mounting bracket 80, as will be discussed more fully hereafter.

Figure 9B:
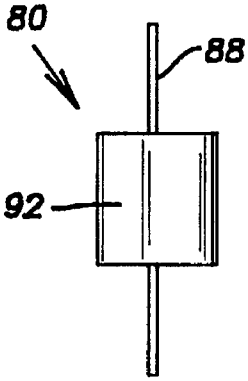
FIG. 9B is a side elevational view of the mounting bracket according to the second embodiment of the present invention.
Figure 9A:
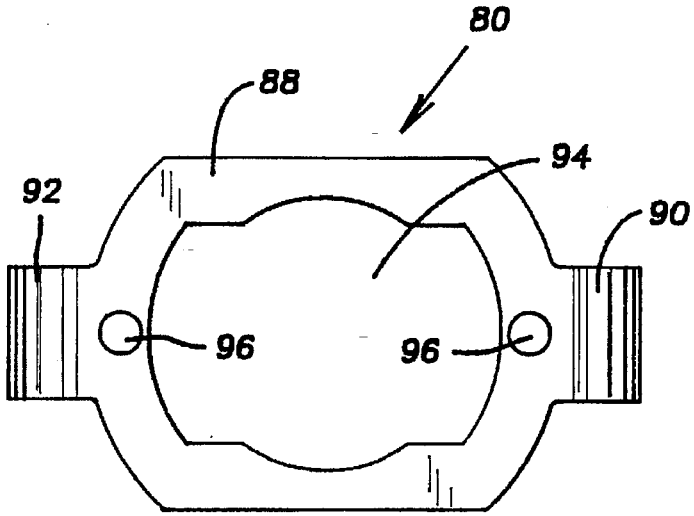
FIG. 9A is a top plan view of the mounting bracket according to the second embodiment of the present invention.
Figure 9C:
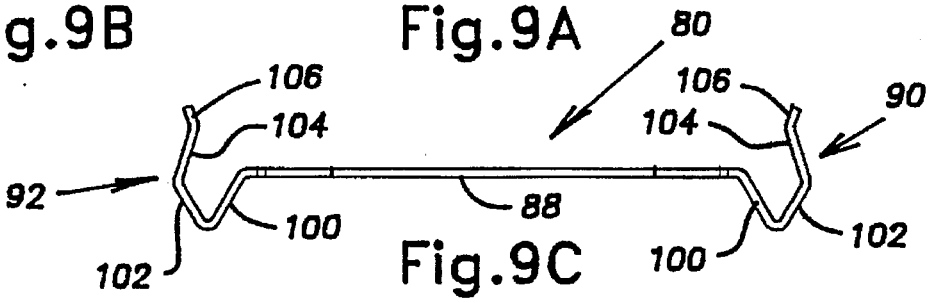
FIG. 9C is a front elevational view of the mounting bracket according to the second embodiment of the present invention.

With reference to FIGS. 9A–9C, the mounting bracket 80 is shown to have a generally planar main body 88 from which first and second mounting wings 90, 92 extend. The main body 88 defines a enlarged central opening 94 through which the burner tube 52 extends. The main body also defines a pair of openings 96 through which mechanical fasteners, such as screws 98, may extend to attach the mounting bracket 80 to the burner 22.

The first and second mounting wings 90, 92 are preferably identical, and each include a first portion 100 extending downwardly and away from the main body 88, a second portion 102 extending upwardly and away from the first portion 100, a third portion 104 angled upwardly and slightly toward the main body 88, and a fourth portion 106 extending upwardly and slightly away from the main body 88.

With reference to FIGS. 7 and 8, the mounting bracket 80 is shown mounted to the burner 22 and secured to the main top panel 20. The mounting wings 90, 92 are elastically received within the mounting openings 86. The annular wall 66 provided by the bottom of the burner 22 and engages the raised portion 82 or first surface of the top panel 20 surrounding the burner opening 84.

As shown best in FIG. 8, when the burner 22 is mounted within the burner opening 84, the mounting wings 90, 92 are in engagement with the inner edge or second surface of the top panel 20 adjacent the mounting openings 86. More specifically, the union of the third and fourth portions 104, 106 engages the inner edge of the main top panel 20.

During installation of the burner 22 and mounting bracket 80 within the burner opening 84, the mounting wings 90, 92 are aligned with the mounting openings 86. The burner tube fitting 53 is inserted into the burner tube and the mounting wings 90, 92 are pushed into the mounting openings 86 such that the second portion 102 engages the inner edge of the top panel and deforms the wings inwardly. Further downward movement of the burner and mounting bracket causes the third portion 104 of the wings to engage the inner surface and, eventually, the annular wall 66 of the burner engages the raised surface 82 and prevents further insertion or downward movement.

The mounting wings 90, 92 resiliently hold the burner in place and help to prevent unintentional removal of the burner from the top panel. However, the burner can be removed for cleaning or maintenance by simply pulling upwardly on the burner with enough force to overcome the resilient retaining force of the mounting wings 90, 92.

Figure 10:
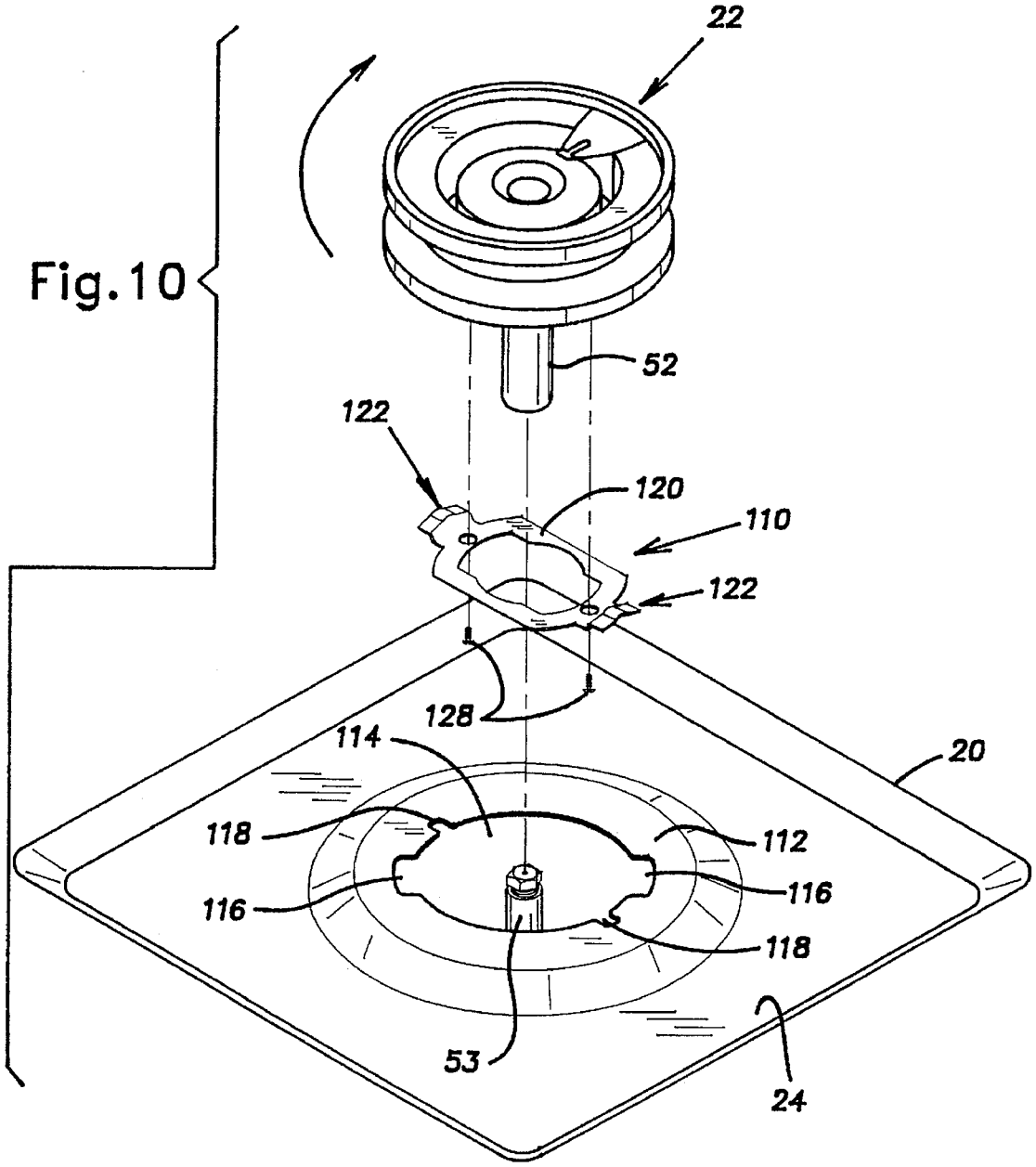
FIG. 10 is an exploded perspective view of a gas burner, mounting bracket, and range top according to a third embodiment of the present invention.

With reference to FIGS. 10–13C, a third embodiment of the present invention is illustrated. FIG. 10 shows a mounting bracket 110 and corresponding main top panel 20. The main top panel 20 defines a well 24 with a raised planar surface 112. A burner opening 114 is formed in the raised surface 112.

The burner opening 114 is generally circular and includes first and second pairs of radially opposed mounting notches 116, 118. The first pair of mounting notches 116 is preferably larger than the second pair of mounting notches 118 for purposes that will be apparent from the following discussion.

Figure 13B:
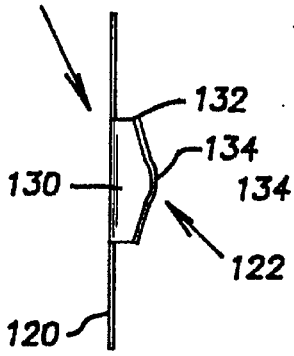
FIG. 13B is a side elevational view of the mounting bracket according to the third embodiment of the present invention.
Figure 13A:
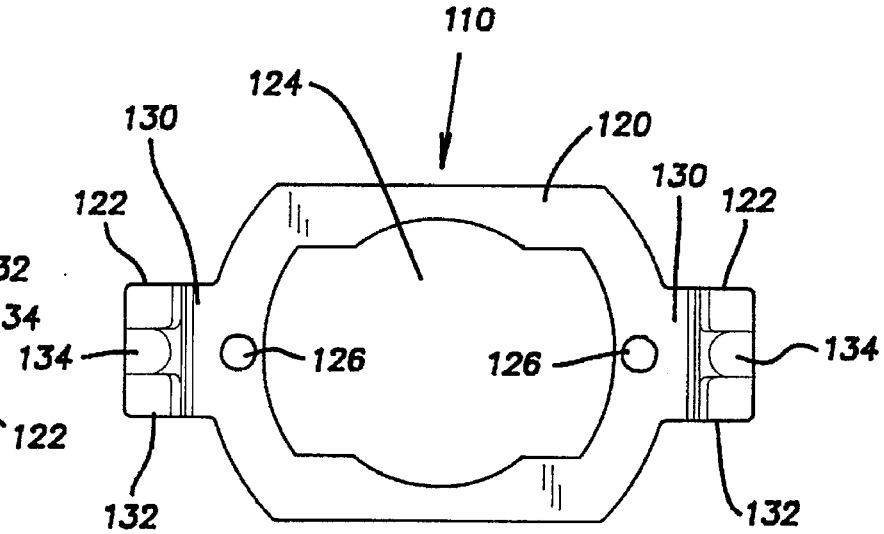
FIG. 13A is a top plan view of the mounting bracket according to the third embodiment of the present invention.
Figure 13C:
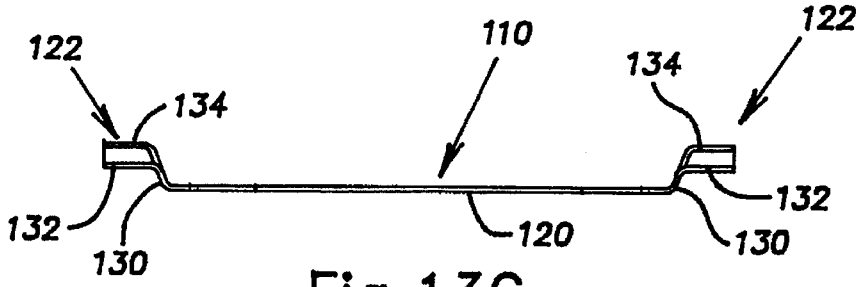
FIG. 13C is a front elevational view of the mounting bracket according to the third embodiment of the present invention.

With reference to FIGS. 13A–13C, the mounting bracket 110 is shown to have a planar main body 120 from which extend a pair of tab-like mounting wings 122. The main body 120 defines an enlarged central opening 124 through which the burner tube 52 extends. The main body 120 also defines a pair of openings 126 through which mechanical fasteners, such as screws 128, may extend to attach the mounting bracket 110 to the burner 22.

The mounting wings 122 are generally identical, and each include a first portion 130 which extends upwardly and away from the main body 120, and a second portion 132 which extends generally longitudinally away from the main body. The second portion 132 includes an upstanding boss 134 in the center thereof which aids in the installation and retention of the mounting bracket/burner, as will be discussed more fully hereafter.

With reference to FIGS. 11 and 12, the mounting bracket 110 is shown mounted to the burner 22 and removably secured to the main top panel 20. The annular wall 66 provided by the burner bottom is in engagement with the raised surface 112 or first surface of the top panel 20 surrounding the burner opening 114. The mounting wings 122 are generally beneath the main top panel 20, with the upstanding bosses 134 extending through the second pair of mounting notches 118 in the raised surface 112. Lateral portions adjacent the bosses 134 engage the lower or second surface of the main top panel, as illustrated.

The mounting bracket 110 and burner 22 are mounted within the burner opening 114 by placing the burner tube 52 over the burner tube fitting 53 and inserting the mounting wings 122 through the first pair of mounting notches 116 in the raised surface 112. The burner is then rotated (clockwise in FIG. 11) such that the mounting wings 122 pass beneath the raised surface 112 with the upstanding boss 134 in engagement with the underside of the top panel. When the mounting wings 122 reach the second pair of mounting notches 118, the bosses 134 snap into the second mounting notches 118 and thereby indicate to the installer that the burner 22 is secured to the top panel.

The burner 22 is removed from the burner opening 114 by rotating the burner so that the mounting wings 122 move from the second mounting notches 118 toward the first mounting notches 116. The bosses 134 extending through the second notches 118 will tend to prevent rotation of the burner, but this tendency can be overcome by the application of sufficient force.

It is submitted that the present invention is capable of numerous modifications, rearrangements, and substitution of parts without departing from the scope and spirit of the invention. Therefore, the scope of the invention shall not be limited to the specific preferred embodiments described herein, but rather will be accorded the full range of coverage and equivalents commensurate with the claims appended hereto.

What is claimed is:

1. A burner assembly, comprising:

a main top panel including a recessed well and defining a burner opening in the well, said top panel having first and second surfaces; said first surface being relatively above said second surface;

a burner having a body member, said body member comprising a lower surface and having a burner tube extending downwardly therefrom; and, a burner mounting bracket secured to the lower surface of the burner, said mounting bracket having a generally planar body member with first and second ends and defining an enlarged opening intermediate said ends, a first mounting wing extends from said first end and a second mounting wing extends from said second end, wherein said burner body member lower surface engages the first surface of the top panel and said mounting wings engage the second surface of the top panel.

2. A burner assembly according to claim 1, wherein said bracket is symmetrical.

3. A burner assembly according to claim 1, wherein said bracket is asymmetrical.

4. A burner assembly, comprising:

a main top panel including a recessed well and defining a burner opening in the well, said top panel having first and second surfaces; said first surface being relatively above said second surface;

a burner having a body member, said body member comprising a lower surface and having a burner tube extending downwardly therefrom; and, a burner mounting bracket secured to the lower surface of the burner, said mounting bracket having first and second mounting wings extending therefrom, wherein said burner body member lower surface engages the first surface of the top panel and said mounting wing engage the second surface of the top panel, and wherein said burner opening has an enlarged center portion through which said burner tube extends and a pair of notched portions which receive said mounting wings.

5. A burner assembly according to claim 4, wherein said burner mounting bracket comprises a generally planar body member having first and second ends and defining an enlarged opening intermediate said ends, said first mounting wing integrally extending from said first end and said second mounting wing integrally extending from said second end.

6. A burner assembly according to claim 5, wherein said bracket is symmetrical.

7. A burner assembly according to claim 5, wherein said bracket is asymmetrical.

8. A burner assembly according to claim 4, wherein said notched portions are adapted to receive either of said first and second wings.

9. A burner assembly according to claim 4, wherein one of said notched portions is adapted to receive only one of said first and second wings.

10. A burner assembly, comprising:

a range top including a recessed well and defining a burner opening in the well, said range top having inner and outer surfaces;

a burner having a body member, said body member including a lower surface and having a burner tube extending downwardly therefrom; and, a burner mounting bracket secured to the lower surface of the burner, said mounting bracket having a generally planar body member with first and second ends and defining an enlarged body opening intermediate said ends, a first mounting wing extends from said first end and a second mounting wing extends from said second end, wherein said lower surface engages the range top outer surface and said mounting wings engage the range top inner surface.

11. A burner assembly according to claim 10, wherein said burner opening has an enlarged center portion through which said burner tube extends and a pair of notched portions which receive said wings.

12. A burner assembly according to claim 11, wherein each of said wings includes an upstanding boss.

13. A burner assembly according to claim 12, wherein each of said bosses extends into an aperture in the range top.

* * * * *